US009840802B2

(12) United States Patent
Zimmerman et al.

(10) Patent No.: US 9,840,802 B2
(45) **Date of Patent: *Dec. 12, 2017**

(54) INDUSTRIAL WASHER DOOR LOCKING MECHANISM AND SYSTEM

(71) Applicant: G.A. Braun, Inc., North Syracuse, NY (US)

(72) Inventors: Mark W. Zimmerman, Syracuse, NY (US); Matthew D. Fenn, Syracuse, NY (US); Ryan J. Blair, Camillus, NY (US); Diedrich D. Willers, Syracuse, NY (US)

(73) Assignee: G.A. Braun, Inc., North Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/644,170

(22) Filed: Jul. 7, 2017

(65) Prior Publication Data

US 2017/0306546 A1 Oct. 26, 2017

Related U.S. Application Data

(63) Continuation of application No. 15/614,103, filed on Jun. 5, 2017, which is a continuation of application No. 14/795,222, filed on Jul. 9, 2015, now Pat. No. 9,689,103.

(60) Provisional application No. 62/158,895, filed on May 8, 2015.

(51) Int. Cl.
*D06F 37/42* (2006.01)
*D06F 37/28* (2006.01)

(52) U.S. Cl.
CPC ..... *D06F 37/28* (2013.01); *D06F 37/42* (2013.01)

(58) Field of Classification Search
CPC ..... D06F 37/42
See application file for complete search history.

(56) References Cited

U.S. PATENT DOCUMENTS 4,623,179 A * 11/1986 Davis ..... D06F 37/42 292/201
2007/0209411 A1* 9/2007 Lim ..... D06F 37/42 70/263

* cited by examiner

*Primary Examiner* — Jason Ko
(74) *Attorney, Agent, or Firm* — Bond Schoeneck & King, PLLC; Jonathan Gray; Frederick Price

(57) ABSTRACT

This disclosure is directed to a washer that will not start the wash sequence until each door is securely fastened shut. In exemplary embodiment, the washer may include at least one door having a locking mechanism that has at least one locking pin. The locking pin may be moved from an unlocked position to a locked position. When the door is shut, the locking pin may be received in a locking pin slot that is disposed in the body of the washer. The locking mechanism may also include a locking bracket that may be engaged with a locking hasp only when the locking pin is in the locked position. The washer may also include a sensor in communication with the controller. The controller only permits the operation of the washer when the sensor detects the locking bracket is engaged with the locking hasp.

5 Claims, 4 Drawing Sheets

INDUSTRIAL WASHER DOOR LOCKING MECHANISM AND SYSTEM

CROSS-REFERENCE TO RELATED APPLICATIONS

This application is a continuation of and claims priority to co-pending U.S. patent application Ser. No. 15/614,103 and entitled "Industrial Washer Door Locking Mechanism and System," which claims priority to U.S. patent application Ser. No. 14/795,222, now issued as U.S. Pat. No. 9,689,103, and entitled "Industrial Washer Door Locking Mechanism and System," which claims priority to U.S. Provisional Patent Application Ser. No. 62/158,895, filed on May 8, 2015, and entitled "Industrial Washer Door Locking Mechanism and System," the entire disclosures of which are incorporated herein by reference.

FIELD OF THE INVENTION

The present invention is generally directed to industrial washers, and, more particularly, to industrial washer safety mechanisms.

BACKGROUND

Industrial Side and End Loading Washer Extractors utilize two types of doors. These types of washer extractors utilize a stationary outer weldment (tub) with an inner divided cylinder that rotates within this tub. The outer tub has a door that opens to give access to the inner cylinder. The inner cylinder has multiple doors providing access to the individual compartments within the divided cylinder. The cylinder may have one, two, three or four compartments, each with an access door. To load this type of washer extractor, the outer tub door must be opened first and then the inner cylinder compartment door(s) is opened allowing the goods to be placed into each compartment.

If the washer is started before the inner doors are completely shut, or if the inner doors open during operation because they were not securely fastened, the washer could be severely damaged, and any user could be injured. Many current designs do not require that the inner doors be completely shut and secured before the washing sequence is initiated. These washers are liable to come open during rotation. Accordingly, there exists a need in the art for a washer that will not begin the wash sequence until each door is securely fastened shut.

SUMMARY

This disclosure is directed to a washer that will not start a wash sequence until each door is securely fastened shut. In exemplary embodiment, the washer may include a door having a locking mechanism that has at least one locking pin. The locking pin may be moveable from an unlocked position to a locked position. When the door is shut, the locking pin may be received in a locking pin slot that is disposed in the body of the washer, securely fastening shut the door of the washer. The locking mechanism may also include a locking bracket that may be engaged with a locking hasp only when the locking pin is in the locked position. The washer may also include a sensor in communication with a controller. The controller in an advantageous embodiment only permits the operation of the washer when the sensor detects the locking bracket is engaged with the locking hasp when the door is closed.

Furthermore, in the embodiments where there are multiple doors, each door may be outfitted with a similar locking mechanism and paired with a single shared or a dedicated sensor to determine whether the door is shut. In those embodiments, the controller may be configured to require that each sensor detect that the door is shut before the washing sequence is permitted.

Using the various embodiments and implementations herein the locking mechanism may provide a safer washer/extractor that will not open during operation, damaging itself or injuring a user.

In a general aspect, an industrial washer is provided that permits operation only when securely shut, and includes but is not limited to: a body defining an inner compartment and a loading opening dimensioned to permit the placement of laundry within the inner compartment; a door, hinged to move between an open position and a closed position, wherein the door is positioned to cover the loading opening; a sensor disposed on the body; a controller in communication with the sensor; a locking mechanism disposed on the door and comprising: at least one locking pin moveable between a locked position and an unlocked position and configured to engage with a locking pin receiving slot when the door is in the closed position and the locking pin is in the locked position, wherein the locking pin receiving slot is disposed in the body; a locking hasp; a locking bracket engageable with the locking hasp when the locking pin is in the locked position; and a sensor target positioned on the locking bracket such that the sensor only detects the sensor target when the door is in the closed position and the locking bracket is engaged with the locking hasp, wherein the controller is configured to permit a washing action only if the sensor target is detected by the sensor.

In accordance with an embodiment, the sensor is an optical sensor and the sensor target is an optical reflector.

In accordance with an embodiment, the sensor is a proximity switch and the sensor target is a conductive member perceivable by the proximity switch.

In accordance with an embodiment, the locking bracket prevents the locking pin from moving into the unlocked position when the locking bracket is engaged with the locking hasp.

In accordance with an embodiment, the locking bracket is coupled to the locking pin, and is dimensioned and spaced from the locking hasp such that it may only be engaged with the hasp when the locking pin is in the locked position.

In accordance with an embodiment, the locking bracket includes an engaging tab and is hinged to move from a first position to a second position.

In accordance with an embodiment, the locking hasp includes a receiving tab, positioned to engage the engaging tab when the locking bracket is in the second position.

In accordance with an embodiment, the hasp is positioned to prevent the locking bracket from moving to the second position when the locking pin is in the unlocked position.

In accordance with an embodiment, the controller is further configured to permit a washing action only if a second sensor target disposed on a second door is detected by a second sensor.

In accordance with an embodiment, the controller is a program logic controller having an internal memory register.

In accordance with an embodiment, the at least one locking pin includes a handle.

In accordance with an embodiment, the locking pin is biased with a spring in the locked position.

In accordance with an embodiment, the locking bracket is biased away from the locking hasp with a spring.

In accordance with an embodiment, the locking pin receiving slot is in communication with the loading opening.

In accordance with an embodiment, the industrial washer further comprises an inner cylinder adapted to rotate with respect to the body.

According to another aspect, an industrial washer permitting operation only when securely shut, includes but is not limited to: a body defining an inner compartment and a first loading opening dimensioned to permit the placement of laundry within the inner compartment; a door, hinged to move between an open position and a closed position, wherein the door is positioned to cover the loading opening; a sensor disposed on the body; a controller in communication with the sensor; a locking mechanism disposed on the door and comprising: at least one locking pin moveable between a locked position and an unlocked position and configured to engage with a locking pin receiving slot when the door is in the closed position and the locking pin is in the locked position, wherein the locking pin receiving slot is disposed in the body; a locking hasp; a locking bracket engageable with the locking hasp when the locking pin is in the locked position, wherein the locking bracket prevents the locking pin from moving into the unlocked position when the locking bracket is engaged with the locking hasp; and a sensor target positioned on the locking bracket such that the sensor only detects the sensor target when the door is in the closed position and the locking bracket is engaged with the locking hasp, wherein the controller is configured to permit a washing action only if the sensor target is detected by the sensor and if a second sensor target disposed on a second door is detected by a second sensor.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
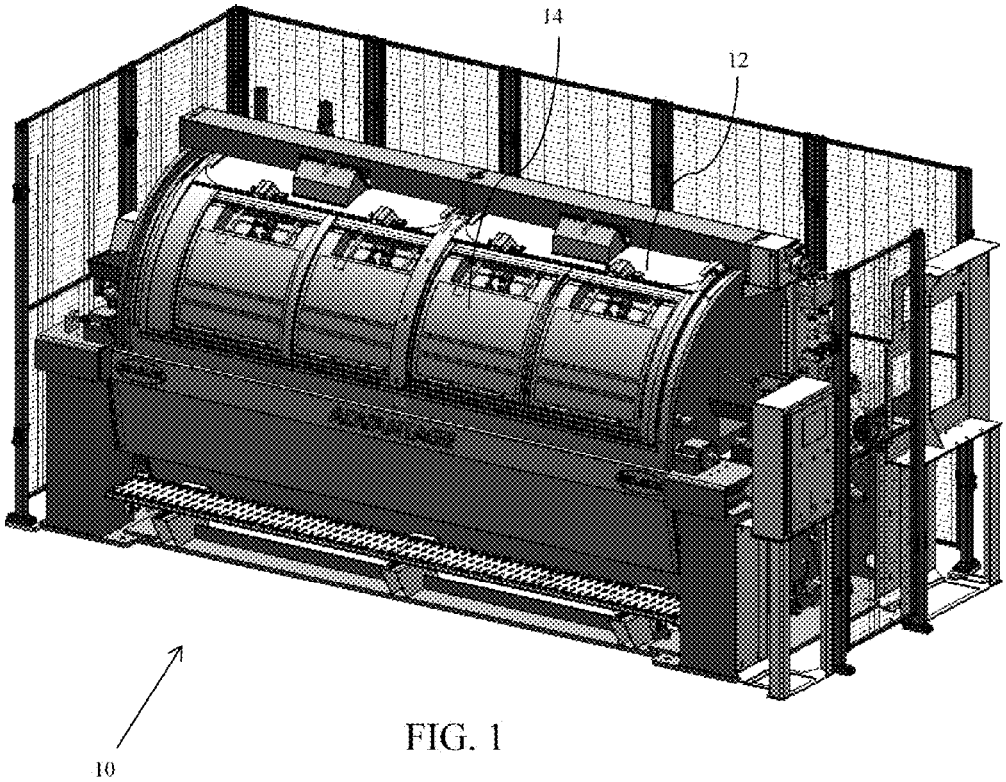
FIG. 1 is a perspective view of a washer, according to an embodiment.

Referring now to the drawings wherein like reference numerals refer to like parts throughout, there is seen in FIG. 1 a perspective view of a washer that permits operation only when securely shut. FIG. 1 shows an industrial washer/extractor 10, that has an outer tub door 12, and a plurality of inner tub doors 14. The inner tub doors may hinge between an open position (not shown) and a closed position. In an exemplary embodiment, the washer 10 will not operate unless each of the inner tub doors 14 are secured in the closed position.

Figure 2:
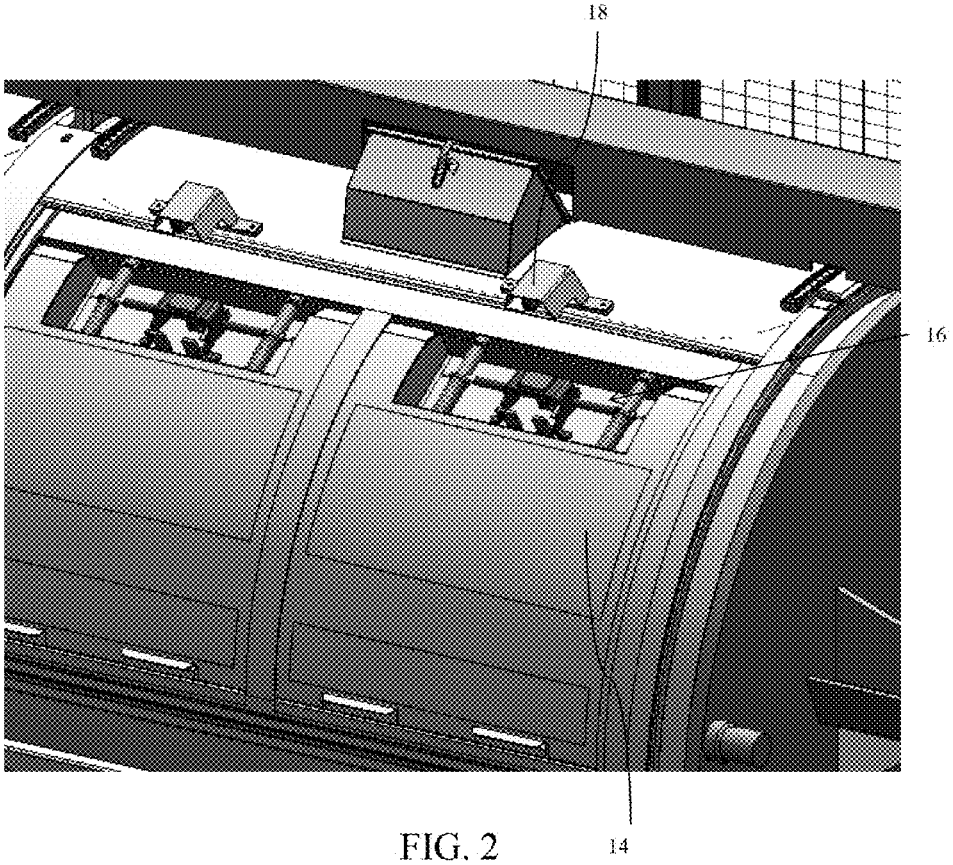
FIG. 2 is a perspective view of a portion of a washer according to an embodiment.

Referring now to FIG. 2, each inner tub door 14 may have a locking assembly 16 (alternately referred to as a locking mechanism), which is designed to securely fasten shut each inner tub door 14. Furthermore, washer 10 may have a plurality of sensors 18 each configured to determine if a respective door is in a closed position (this process will be discussed in depth below). Although an optical sensor is depicted in FIG. 2, one of ordinary skill in the art will appreciate in conjunction with a review of this disclosure that any sensor suitable for detecting the position of the door, as described below, may be used.

Figure 3:
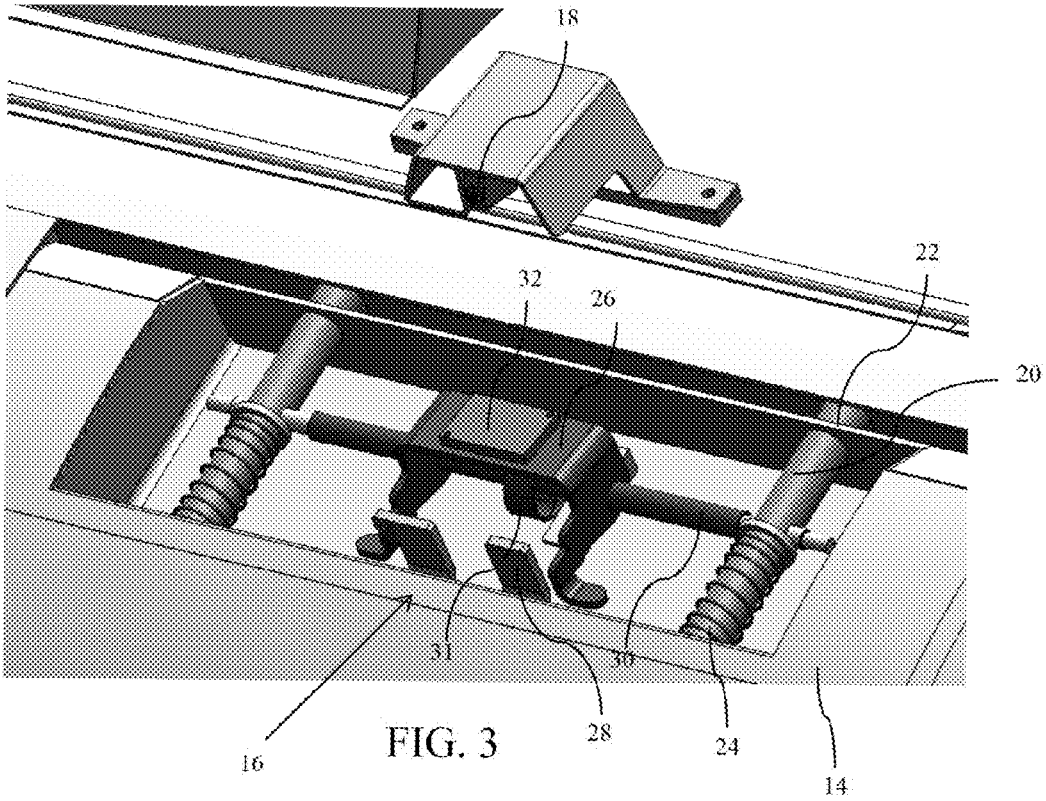
FIG. 3 is a perspective view of a portion of a washer according to an embodiment.

FIG. 3 shows a locking assembly 16 in more detail. As shown, locking assembly 16 may comprise locking pins 20. Locking pins 20 are moveable between a locked position and an unlocked position. (The locking pins 20 may be fashioned, for example, out of 1.25" diameter stainless steel rods. Although, different material (preferably containing a metal) and sizes are contemplated as should be appreciated by those of skill in the art in conjunction with a review of this disclosure.). Although two locking pins 20 per locking assembly are shown, one of ordinary skill in the art will appreciate that one or more pins may be used. When locking pins 20 are moved in the locked position when the inner tub door 14 is in the closed position, the locking pins are received in locking pin receiving slots 22, which, in an exemplary embodiment, are defined in the body of the washer 10. When locking pins 20 are engaged in the locking pin receiving slots 22, the inner tub door 14 is fastened shut as the door may not be opened without first retracting the locking pins 20 into an unlocked position. To retain the locking pins 20 in the locked position, they may be biased with a spring 24, such as a compression spring (although other kinds of springs may be used), into the locked position.

It should also be noted that the spring will require that the locking pins 20 be manually moved into the unlocked position before the inner tub door 14 may be shut, whereupon releasing the locking pins 20 will allow them to automatically engage in the locking pin receiving slots 22. Thus, to close inner tub door 14, locking pins must be first slid into the unlocked position.

Figure 4:
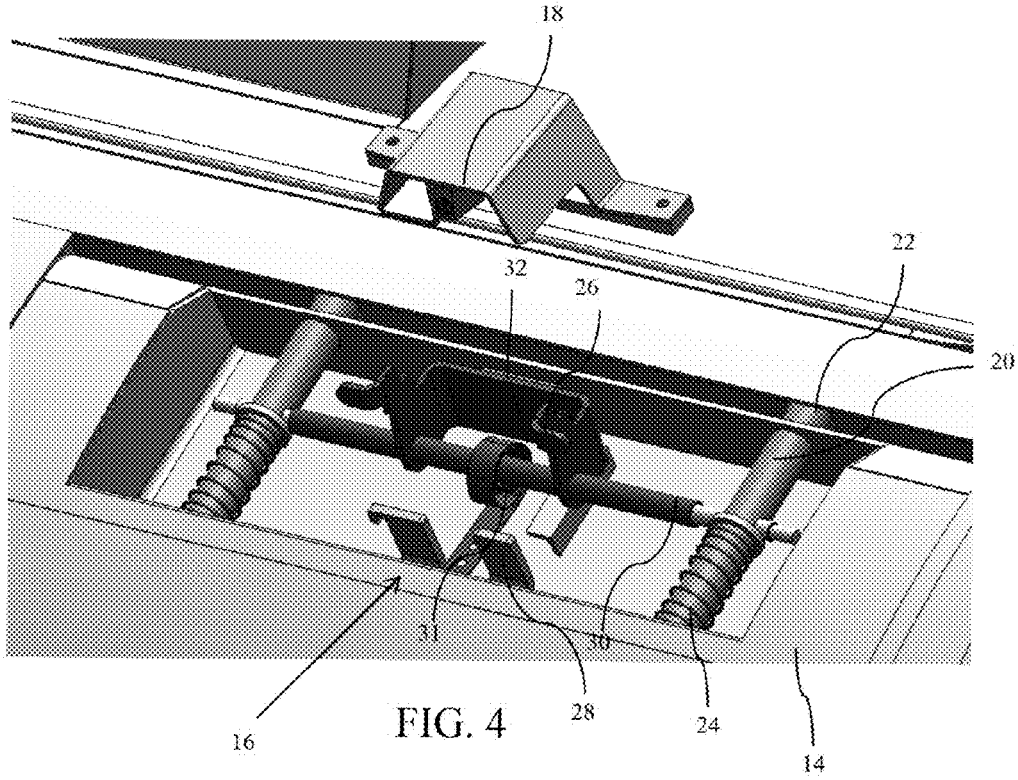
FIG. 4 is a perspective view of a portion of a washer according to an embodiment.

As further shown in FIG. 3, locking assembly 16 may include a locking bracket 26, and locking hasp 28. Locking bracket 26 may be coupled to locking pins 20, such that the locking bracket 26 will slide up and down with locking pins 20 as locking pins 20 are moved between the unlocked and locked positions. As shown in FIG. 4, locking bracket 26 may be coupled to the locking pins via a connecting rod 30. (In an exemplary embodiment, the connecting rod may be fashioned out of ½' stainless steel, and may taper at either end). Connecting rod 30 may also provide a convenient handhold to lower locking pins 20 into the unlocked or locked position. Locking bracket 26 may be further hinged between a first position and a second position. In the second position, locking bracket 26 may be engaged with locking hasp 28. It should be noted that, in an exemplary embodiment, locking bracket 26 and locking hasp 28 are dimensioned and spaced such that the locking bracket may only move into the second position, when spaced sufficiently apart from locking hasp 28. In other words, locking bracket 26 may only engage with locking hasp 28 when the locking bracket 26 is slid away from the locking hasp 28, when locking pins 20 are in the locked position. If the locking pins are in the unlocked position, locking bracket 26 is positioned too near to locking hasp 28 and will be prevented from moving into the second position by locking hasp 28. Furthermore, when engaged with locking hasp 28, locking bracket 26 may be configured to abut locking hasp 28 such that the locking pins 20 may not be slid into the unlocked position. Thus, locking bracket 26 may only be engaged with locking hasp 28 when locking pins 20 are in the locked position, and locking pins 20 may not be slid back into the unlocked position until locking bracket 26 has been disengaged from locking hasp 28.

FIG. 4 shows the locking bracket 26 in the first, disengaged, position, while FIG. 3 shows the locking bracket in the second, engaged, position. It should be noted that locking bracket 26 may be biased in the first position, using a spring 31 (here shown as a coiled metal spring, although other springs may be used).

Returning back to FIG. 3, a sensor target 32, may be disposed upon locking bracket 26. Sensor target, here an optical reflector, may be any material that is capable of being sensed by sensor 18 when the inner tub door 14 is in the closed position and locking bracket 26 is engaged with locking hasp 28. In an exemplary embodiment, sensor 18 is an optical sensor (for example, a polarized photoeye sensor) and sensor target 28 is an optical reflector disposed on the top surface of locking bracket 26, such that a signal is reflected off of sensor target 32 only when the inner tub door 14 is closed and locking bracket 26 is engaged with locking hasp 28. Of course, as described above, this will also require that locking pins 20 be engaged in the locking pin receiving slots 22 and the inner tub door 14, consequently, is fastened shut. Thus, in a preferable embodiment, sensor 18 only detects sensor target 32 when the tub door 14 is fastened in the closed position (although, other sensing positions are contemplated).

As noted, FIG. 4 shows the locking bracket 26 in the open position, as shown when the inner tub door 14 is open. In this position, the spring 31 holds the locking bracket 26 toward the top of the cylinder compartment door and prevents the sensor 18 located on the Tub outer door 12 from receiving the reflected light beam.

One of ordinary skill in the art will appreciate that sensor 18 and sensor target 32 need not be an optical sensor and an optical reflector, respectively. Rather, any sensor 18 capable of detecting when sensor target 32 is properly positioned (i.e. inner tub door 14 is fastened shut and locking bracket 26 is engaged). Thus, alternatively, sensor 18 may be a proximity switch and sensor target 32 a conductor that may be detected by the proximity switch when properly positioned. Other sensors 18 and sensor targets 32 may be used according to the requirements described herein as will be appreciated by a person of ordinary skill in the art.

Washer 10 may further comprise a controller 34 (not shown) in communication with sensor 18. Controller 34 may be configured to prevent washer 10 from operating unless sensor 18 detects the presence (or, alternatively, no longer detects the presence) of sensor target 32 (and, necessarily, that inner tub door 14 is in the closed position). In the embodiment where there are multiple inner tub doors 14, controller may require that each sensor 10, respectively associated with an inner tub door 14, detect the presence of the respective sensor target 32 before it will allow operation of washer 10. In this way, each inner tub door 14 must be in securely fastened in the closed position before washer 10 may be operated.

For example, once the sensor 18 receives the reflected signal from the sensor target 32 (or, alternatively, no longer detects a signal from the sensor target 32), the sensor's internal contact may closed, sending a 24*v* digital signal back to an input/output (I/O) rack located in the low voltage control box (not shown). This input signal sets a flag in the internal memory register of the controller 34, in this example a Program Logic Controller (PLC), memory, which is interrupted by the PLC software as proving the door is locked. Once this signal is received, the PLC software allows for operation of the outer Tub door and all other wash functions to occur via manual inputs from a person operating the PLC touchscreen controller.

One of ordinary skill in the art will appreciate that although a controller is described herein, a dedicated computer, FGPA, ASIC, or other computing device having a nontransitory storage medium and capable of receiving a signal from a sensor and controlling the operation of washer 10, may be used. Alternatively, a combination of computing devices, such as the ones described above, may be used in concert to receive the signal from sensor 18 and control the functioning of washer 10. The computing devices may be local or remote and operated over the cloud or through some other wireless communication medium.

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

As will be appreciated by one skilled in the art, aspects of the present invention may be embodied/implemented as a computer system, method or computer program product. The computer program product can have a computer processor or neural network, for example that carries out the instructions of a computer program. Accordingly, aspects of the present invention may take the form of an entirely hardware embodiment, an entirely software embodiment, and entirely firmware embodiment, or an embodiment combining software/firmware and hardware aspects that may all generally be referred to herein as a "circuit," "module," "system," or an "engine." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction performance system, apparatus, or device.

The program code may perform entirely on the user's computer, partly on the user's computer, completely or partly on the thermal printer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The flowcharts/block diagrams in the Figures illustrate the architecture, functionality, and operation of possible implementations of systems, methods, and computer program products according to various embodiments of the present invention. In this regard, each block in the flowcharts/block diagrams may represent a module, segment, or portion of code, which comprises instructions for implementing the specified logical function(s). It should also be noted that, in some alternative implementations, the functions noted in the block may occur out of the order noted in the figures. For example, two blocks shown in succession may, in fact, be performed substantially concurrently, or the blocks may sometimes be performed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While several embodiments of the invention have been discussed, it will be appreciated by those skilled in the art that various modifications and variations of the present invention are possible. Such modifications do not depart from the spirit and scope of the present invention.

What is claimed is:

1. An industrial washer permitting operation only when secured, comprising:

a body defining an inner compartment and a loading opening dimensioned to permit placement of laundry within the inner compartment, a washer door, configured to move between an open position and a closed position, and positioned to cover the loading opening in the closed position;

a locking bracket moveable between a locked position and an unlocked position; wherein, in the locked position, the locking bracket is secured against a locking surface, wherein the locking bracket is only secureable against the locking surface when the washer door is in the closed position;

a sensor disposed on the body; and a sensor target positioned on the washer door such that the sensor target is only detectable by the sensor when the washer door is in the closed position.

2. The industrial washer of claim 1, further comprising a controller in communication with the sensor, the controller being configured to permit operation only if the sensor detects the sensor target.

3. The industrial washer of claim 1, further comprising a plurality of sensor targets and a plurality of sensors, wherein the plurality of sensor targets are each only detectable by a respective sensor of the plurality of sensors when the washer door is in the closed position.

4. The industrial washer of claim 3, further comprising a controller in communication with each sensor of the plurality of sensors and configured to permit operation only if each sensor of the plurality of sensors detects a respective sensor target of the plurality of sensor targets.

5. The industrial washer of claim 1, wherein the industrial washer further comprises an outer washer door.

* * * * *